US011458745B2

(12) United States Patent
Wakakusa et al.

(10) Patent No.: US 11,458,745 B2
(45) Date of Patent: Oct. 4, 2022

(54) IMAGE RECORDING APPARATUS

(71) Applicant: Brother Kogyo Kabushiki Kaisha, Nagoya (JP)

(72) Inventors: Keisuke Wakakusa, Nagoya (JP); Tsuyoshi Ito, Nagoya (JP); Shohei Ichikawa, Kasugai (JP); Masatake Sato, Ichinomiya (JP); Yoshimitsu Taniguchi, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 463 days.

(21) Appl. No.: 16/582,669

(22) Filed: Sep. 25, 2019

(65) Prior Publication Data

US 2020/0101772 A1 Apr. 2, 2020

(30) Foreign Application Priority Data

Sep. 28, 2018 (JP) ..... JP2018-185270

(51) Int. Cl.
*B41J 11/42* (2006.01)
*B41J 13/03* (2006.01)
(Continued)

(52) U.S. Cl.
CPC ..... *B41J 11/42* (2013.01); *B41J 11/0095* (2013.01); *B41J 13/0009* (2013.01); *B41J 13/03* (2013.01);
(Continued)

(58) Field of Classification Search
CPC .... B41J 11/42; B41J 11/0095; B41J 13/0009; B41J 13/03; B41J 13/0018; B41J 13/0027; B41J 13/0036
See application file for complete search history.

(56) References Cited

U.S. PATENT DOCUMENTS 6,168,270 B1 * 1/2001 Saikawa ..... B41J 13/103 271/119
2005/0088472 A1 4/2005 Nunokawa
2014/0354728 A1 * 12/2014 Murata ..... B41J 11/002 347/16

FOREIGN PATENT DOCUMENTS

JP H02-253273 A 10/1990
JP 2004-322590 A 11/2004
(Continued)

OTHER PUBLICATIONS

May 31, 2022—(JP) Notice of Reasons for Refusal—JP App No. 2018-185270, Eng Tran.

*Primary Examiner* — Henok D Legesse
(74) *Attorney, Agent, or Firm* — Banner & Witcoff, Ltd.

(57) ABSTRACT

An image recording apparatus is configured to perform a conveying process of a recording medium using a conveying roller and a discharging roller, a recoding process of recording an image on the printing sheet when the conveying process is not performed, and an adjusting process. In the adjusting process, among a plurality of conveying processes performed within a period from the start of the conveying process for an n-th printing sheet until the timing which is after the start of the conveying process for an (n+1)-th printing sheet, the conveying amount of the printing sheet subject to at least one conveying process is adjusted such that a timing when the trailing end of the n-th printing sheet passes through the discharging roller is within one of the acceleration period and the deceleration period of the conveying process for the printing sheet.

13 Claims, 11 Drawing Sheets

(51) Int. Cl.
*B41J 11/00* (2006.01)
*B41J 13/00* (2006.01)

(52) U.S. Cl.
CPC ..... *B41J 13/0018* (2013.01); *B41J 13/0027* (2013.01); *B41J 13/0036* (2013.01)

(56) References Cited

FOREIGN PATENT DOCUMENTS

| | | | |
|---|---|---|---|
| JP | 2005081780 | A | 3/2005 |
| JP | 2005148650 | A | 6/2005 |
| JP | 2007144980 | A | 6/2007 |

* cited by examiner

CONVEYING DIRECTION

IMAGE RECORDING APPARATUS

CROSS-REFERENCE TO RELATED APPLICATIONS

This application claims priority under 35 U.S.C. § 119 from Japanese Patent Application No. 2018-185270 filed on Sep. 28, 2018. The entire subject matter of the application is incorporated herein by reference.

BACKGROUND

Technical Field

The present disclosures relate to an image recording apparatus provided with a first roller which conveys a recording sheet to an image recording area and a second roller which discharges the recording sheet on which the image is recorded outside the image recording apparatus, the first roller and the second roller being driven by a single motor.

Related Art

There has been known an inkjet printer which has a conveying roller to convey a printing sheet to an ink ejection area, a printing section configured to perform printing on the printing sheet conveyed to the ink ejection area, a discharge roller to discharge the printing sheet on which the image is printed from the ink ejection area, and a discharge stacker configured to hold a plurality of discharged printing sheets on which images are printed in a stacked manner. In such an inkjet printer, the conveying roller and the discharge roller are typically driven by a single motor.

In the printer as described above, if a conveying speed when the printing sheet is discharged by the discharge roller is too fast, the printing sheets will not be stacked in a well-aligned manner. To avoid such a problem (so that the discharged printing sheets are stacked in a well-aligned manner), when a trailing end portion of the printing sheet is discharged to the discharge stacker, the motor is typically controlled such that the conveying speed by the discharging roller is slightly lowered.

SUMMARY

When driving forces for the conveying roller and the discharge roller are transmitted from a single motor as above, if the conveying speed of the discharge roller is lowered, the conveying speed of the printing sheet conveyed by the conveying roller is also lowered, thereby throughput of printing by the printer images is lowered.

In view of the above, aspects of the present disclosures provide an image recording apparatus capable of making the printing sheets be stacked on the discharged sheet tray in well-aligned manner with suppressing lowering of the throughput of printing images.

According to aspects of the present disclosure, there is provided an image recording apparatus comprising a carriage configured to move in a scanning direction, a recording head mounted on the carriage and movable together with the carriage in the scanning direction, the recording head being configured to record an image on a printing medium, a discharged sheet tray configured to accommodate the recording medium on which the image is recorded, a conveyer configured to convey the recording medium in a conveying direction perpendicular to the scanning direction, the conveyer including a first roller and a second roller, the second roller being disposed on a downstream side with respect to the first roller in the conveying direction, the first roller being configured to convey the recording medium to an image recording area facing a movable range of the recording head, the second roller being configured to discharge the recording medium on the discharged sheet tray, a driving mechanism including a single motor, the driving mechanism being configured to drive both the first roller and the second roller with use of the single motor as a driving source, and a controller. Wherein the controller is configured to perform a conveying process of conveying the recording medium using at least one of the first roller and the second roller, a recording process of recording an image on the recording medium using the recording head while moving the carriage in the scanning direction when the conveying direction is not performed, and an adjusting process of adjusting a conveying amount of the printing medium subject to at least one conveying process among a plurality of conveying processes performed within a particular conveying period such that a timing when a trailing end, in the conveying direction, of an n-th printing medium, which is one of a plurality of recording mediums subject to the recording process, passes through the second roller is within one of an acceleration period and a deceleration period in the plurality of conveying processes. Wherein n is an arbitrary natural number, the particular conveying period is a period from a start of a conveying process for an n-th printing medium until a timing after a start of a conveying process for an (n+1)-th printing medium and before an end of the conveying process for the n-th printing medium.

BRIEF DESCRIPTION OF THE ACCOMPANYING DRAWINGS

FIG. 1 schematically shows a side view of a printer according to an illustrative embodiment showing an internal configuration thereof.

Figure 3A:
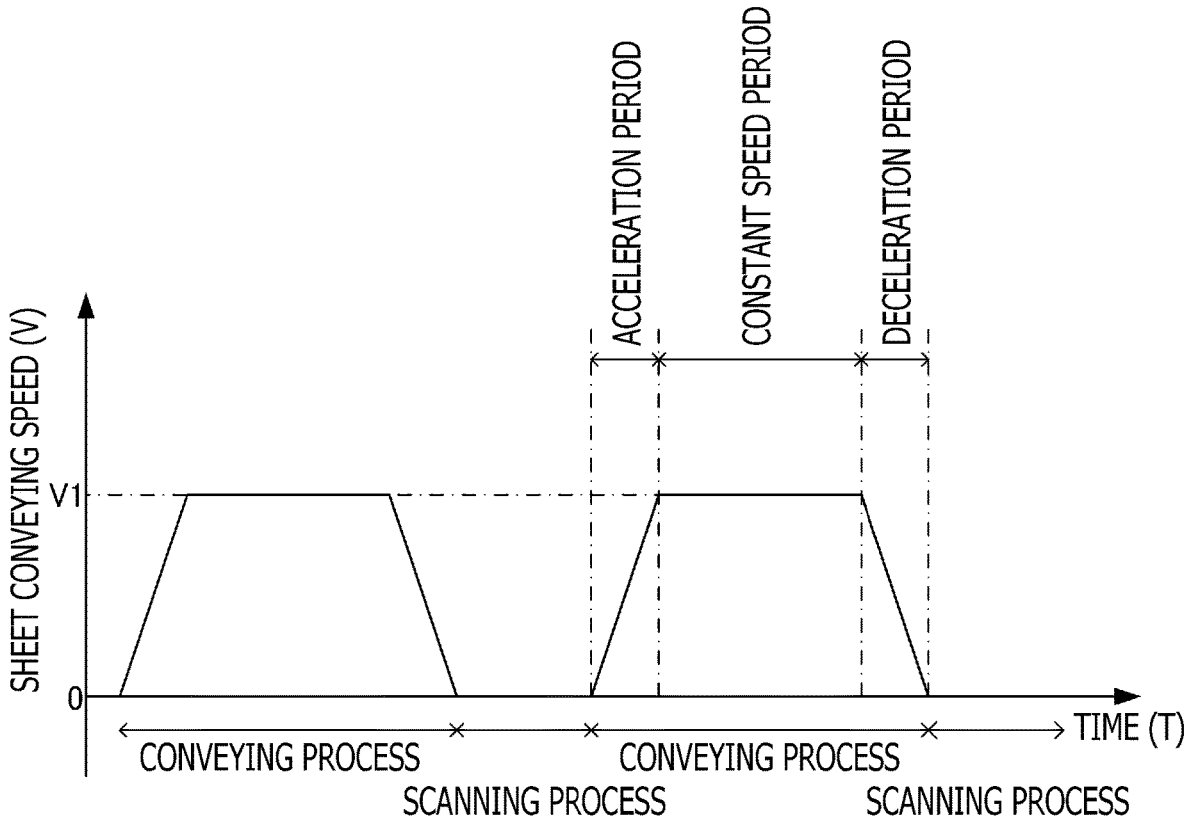
FIG. 3A is a graph showing a relationship between a conveying speed of a printing sheet and an elapsed time.
Figure 3B:
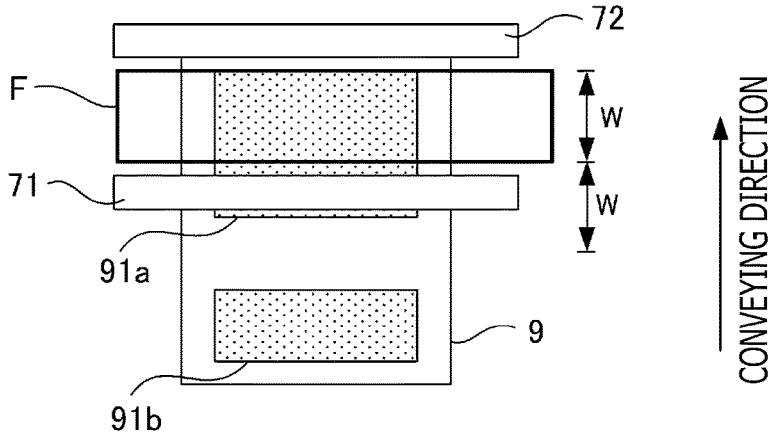

FIG. 3B schematically shows a normal conveying process.

Figure 4A:
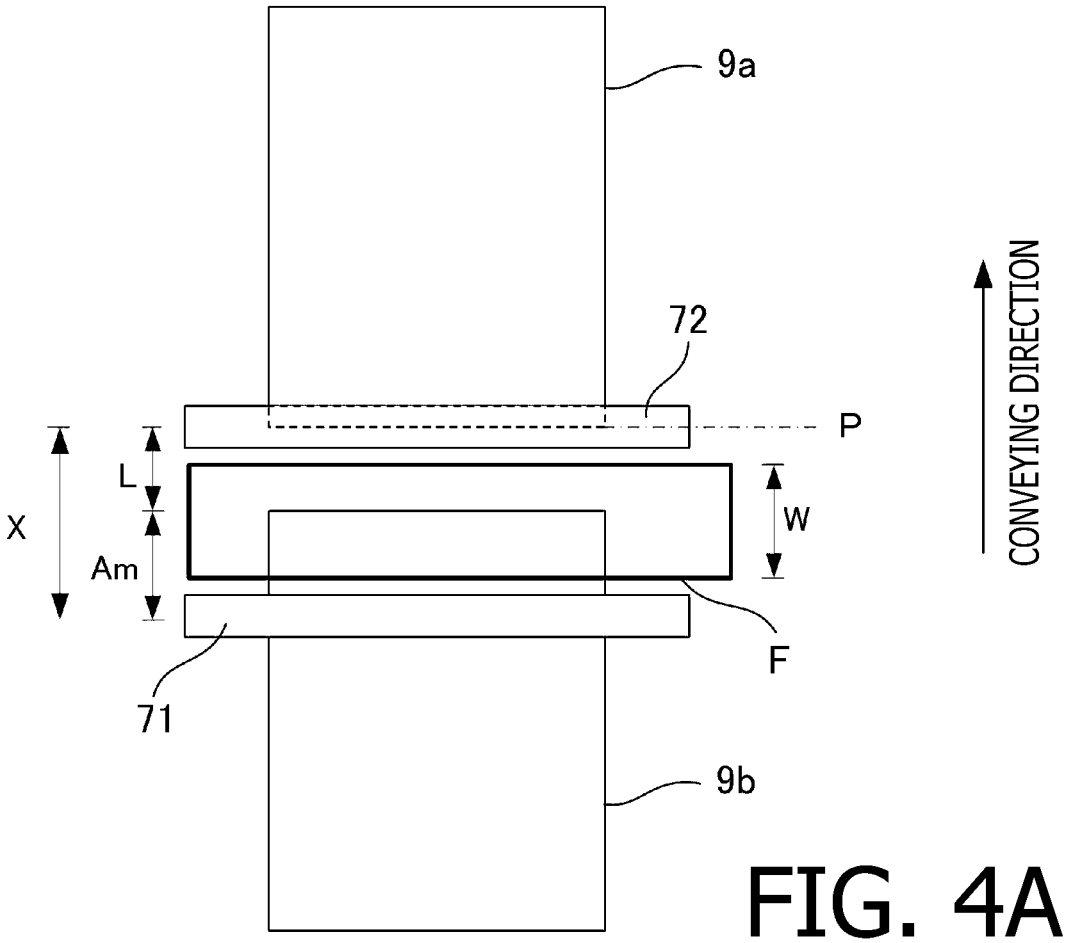

FIG. 4A is a plan view showing a situation where an n-th printing sheet and an (n+1)-th printing sheet are conveyed by a conveying roller pair and a discharging roller pair.

Figure 4B:
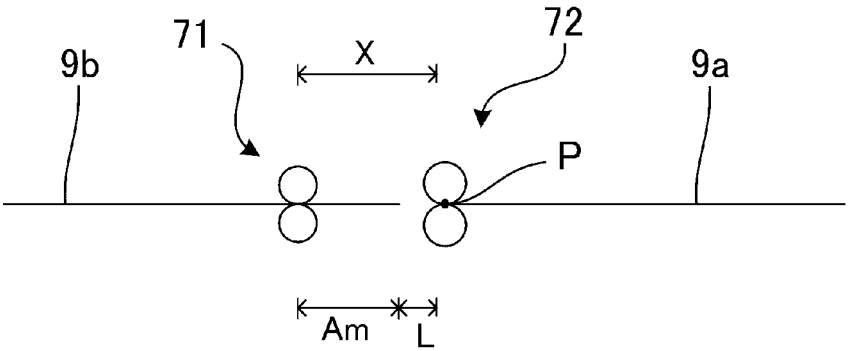

FIG. 4B is a side view showing the situation where the n-th printing sheet and the (n+1)-th printing sheet are conveyed by the conveying roller pair and the discharging roller pair.

Figure 5A:
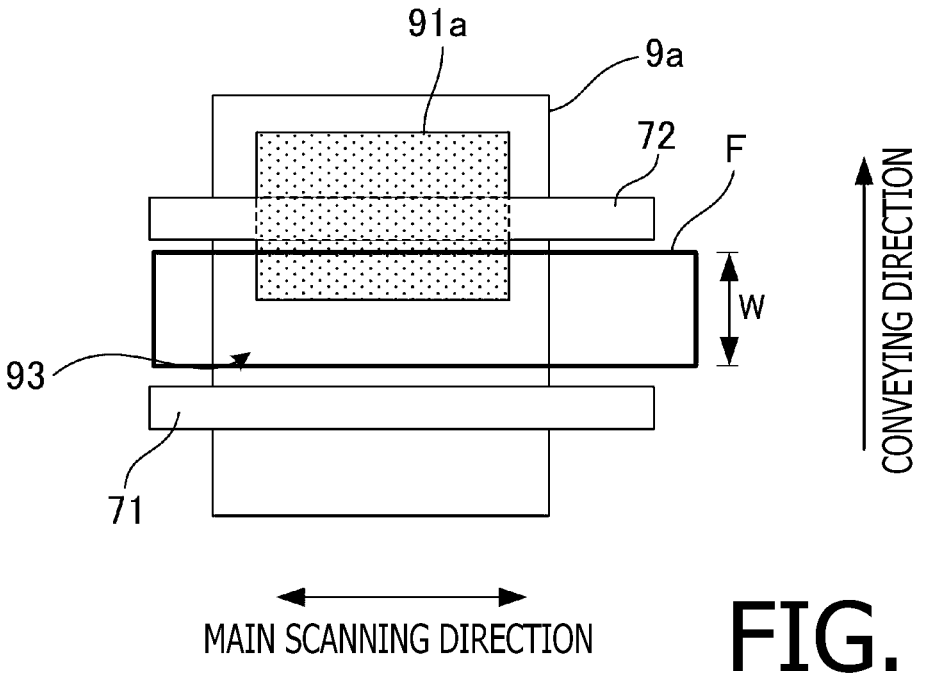

FIG. 5A illustrates a first method of an adjusting process performed by a controller at a timing immediately before the adjusting process is performed.

Figure 5B:
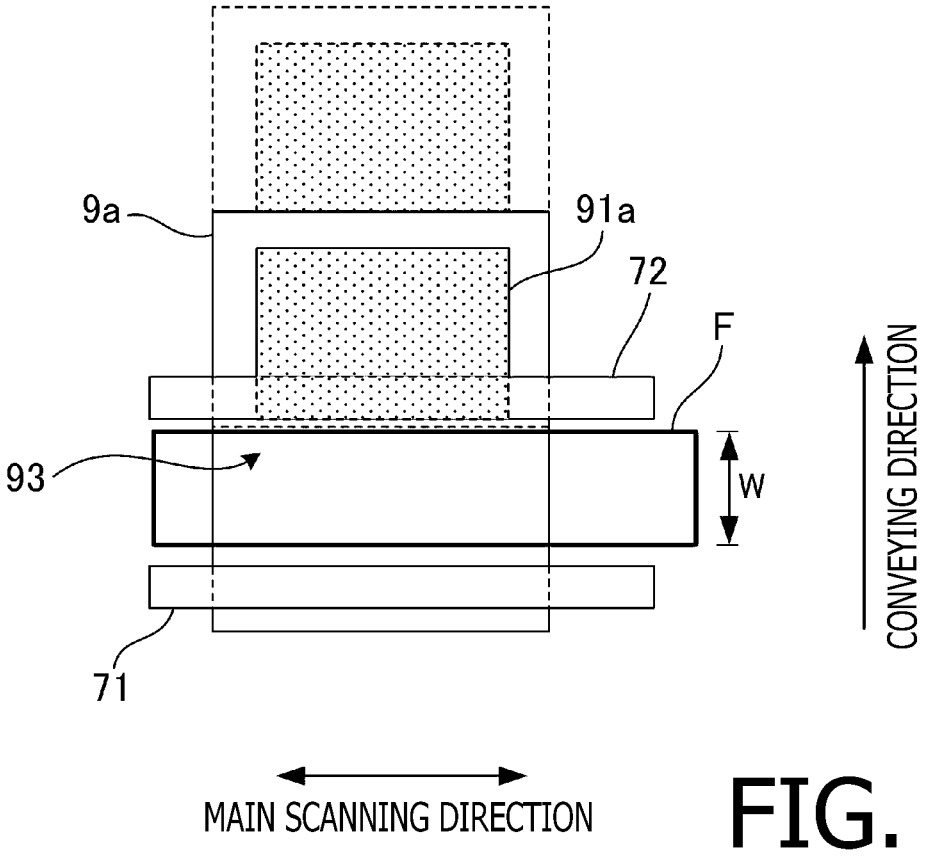

FIG. 5B illustrates the first method of the adjusting process performed by the controller after the adjusting process is performed.

Figure 6A:
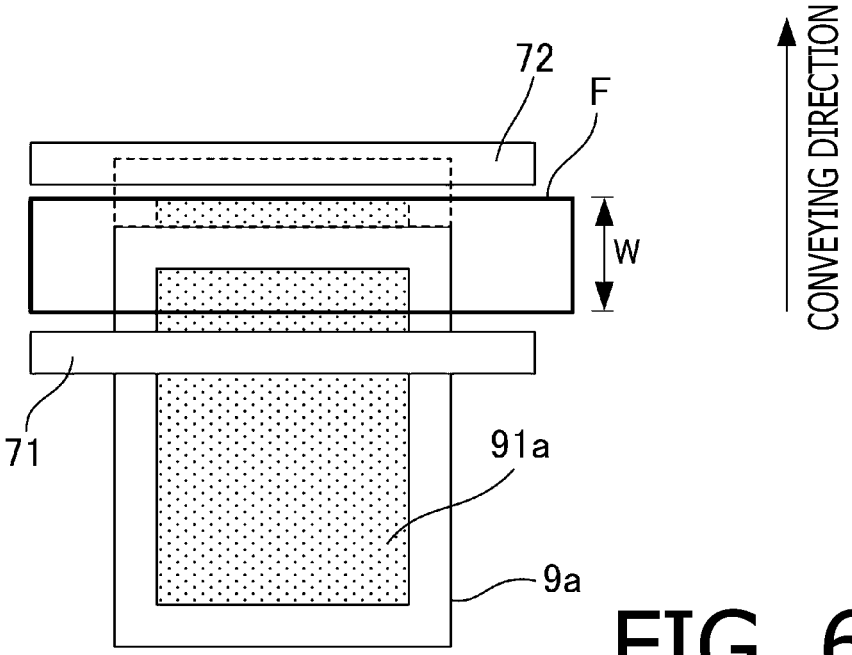

FIG. 6A illustrates a second method of an adjusting process performed within a front end portion of an image forming area.

Figure 6B:
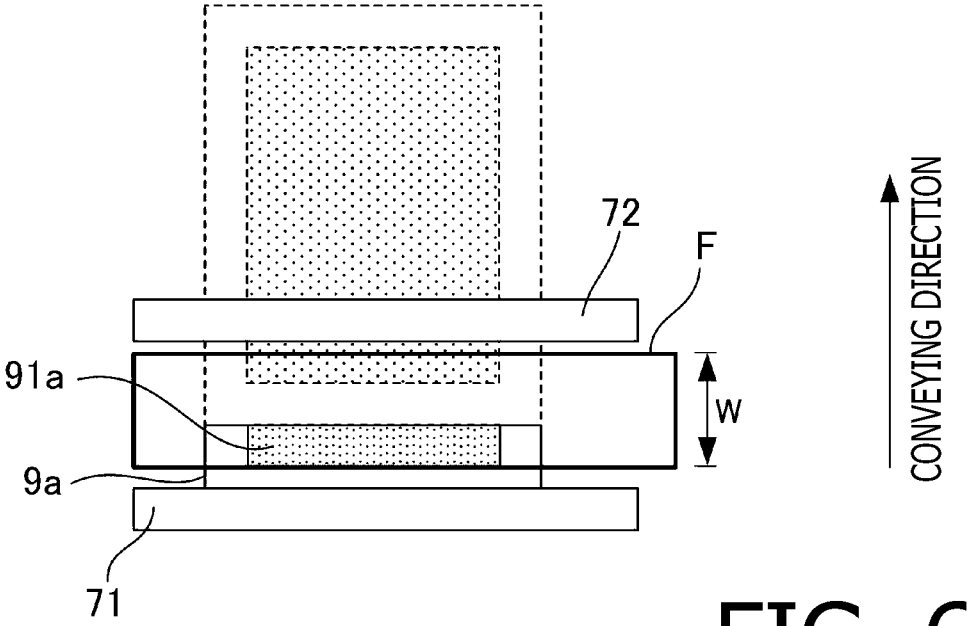

FIG. 6B illustrates the second method of the adjusting process performed within a rear end portion of the image forming area.

Figure 1:
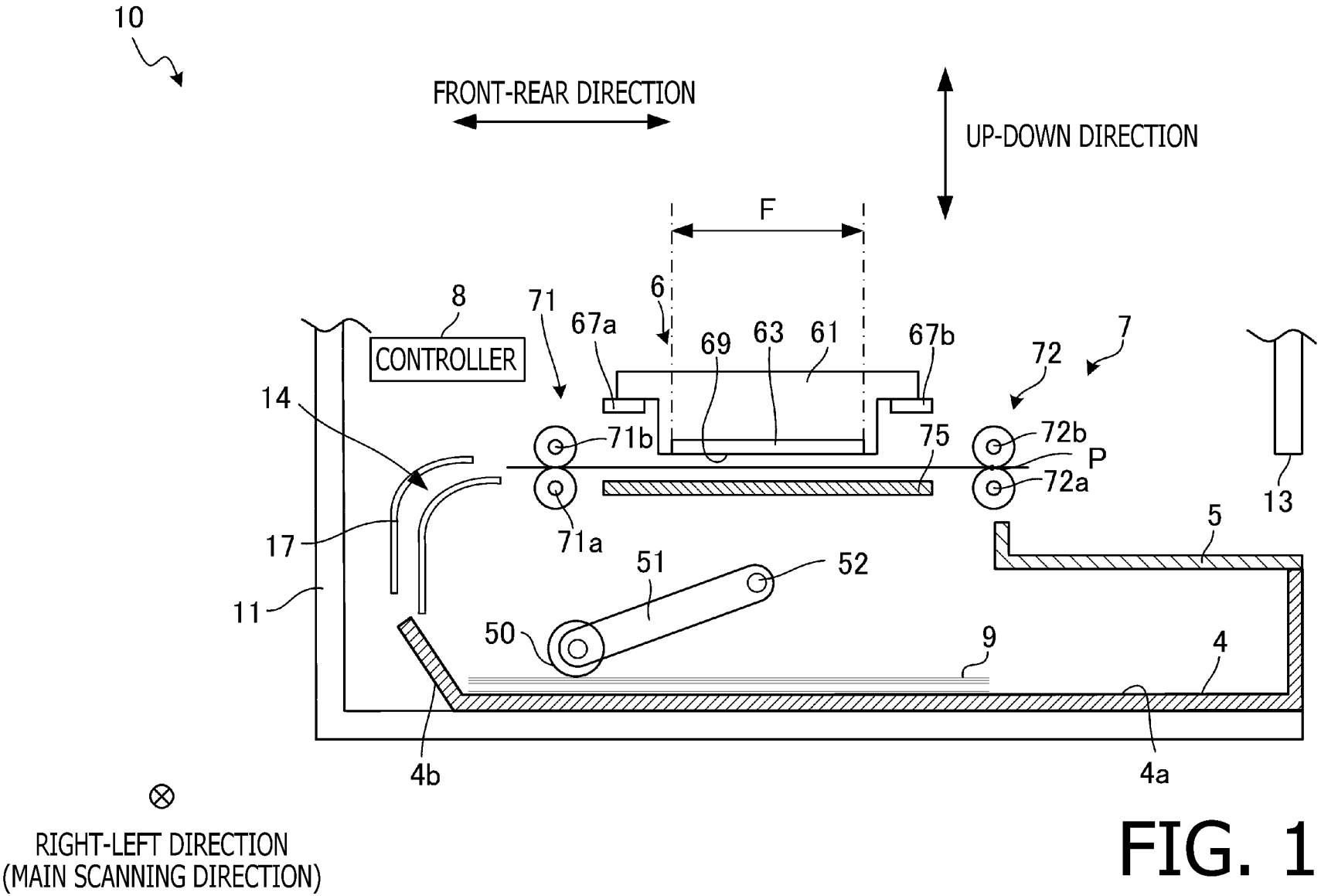
Figure 7:
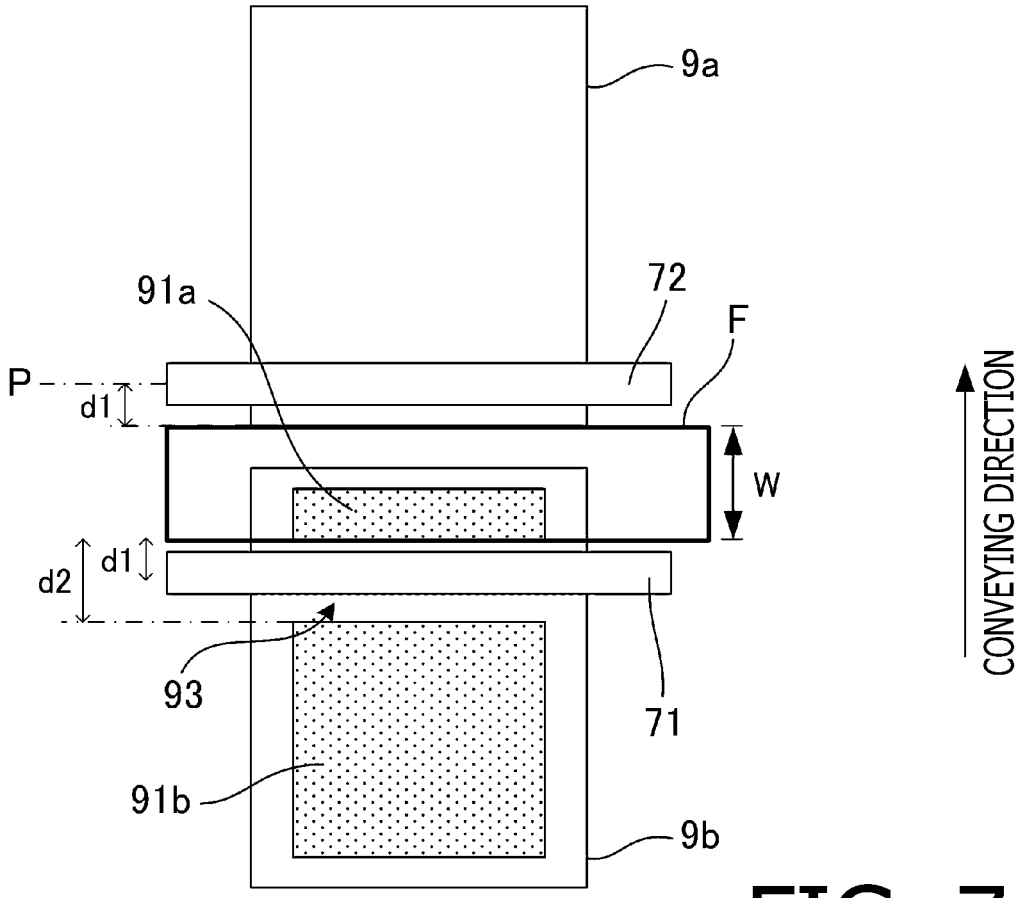

FIG. 7 illustrates a third method of an adjusting process performed by the controller shown in FIG. 1.

Figure 8:
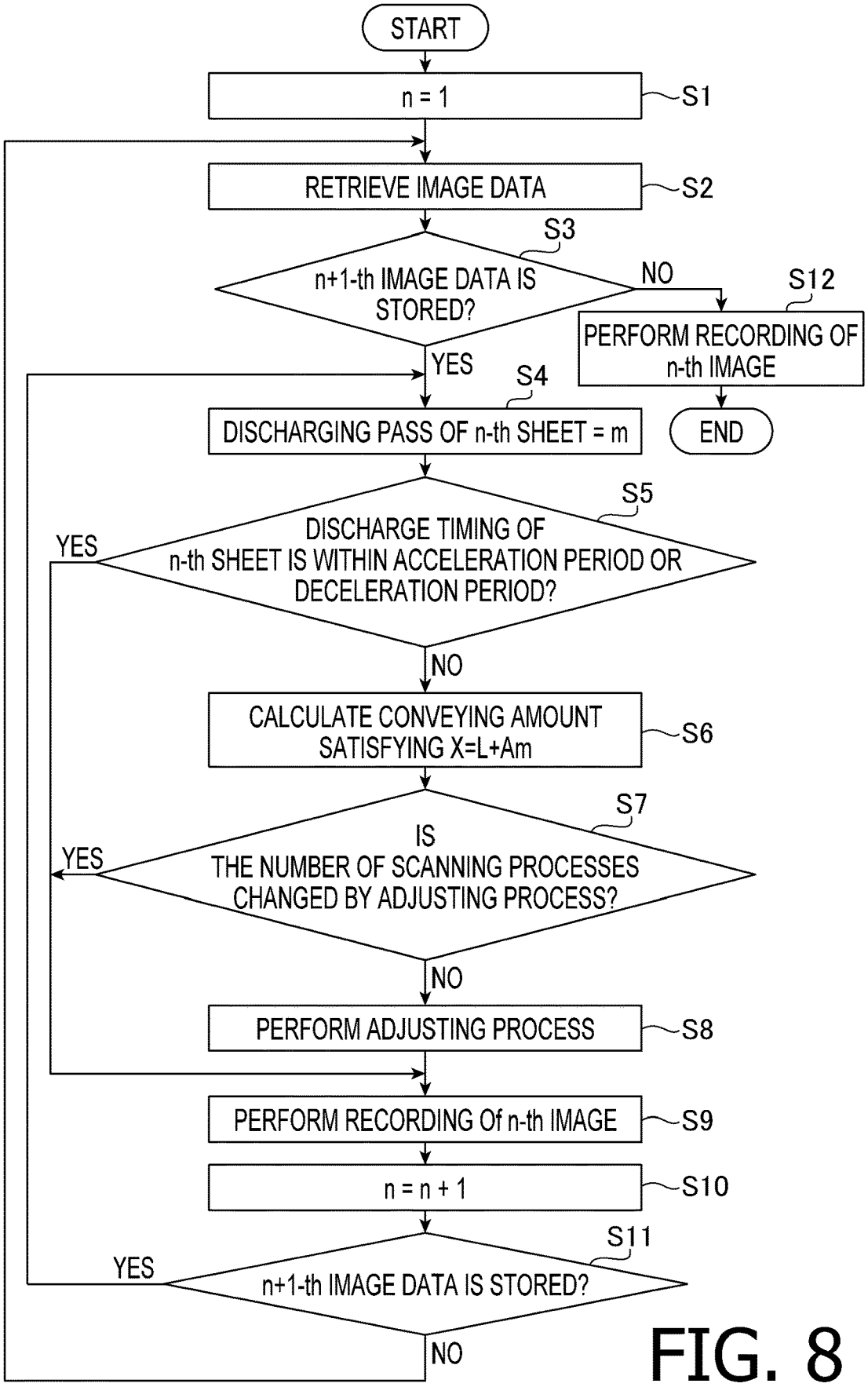

FIG. 8 is a flowchart illustrating a process performed by the controller shown in FIG. 1.

Figure 9A:
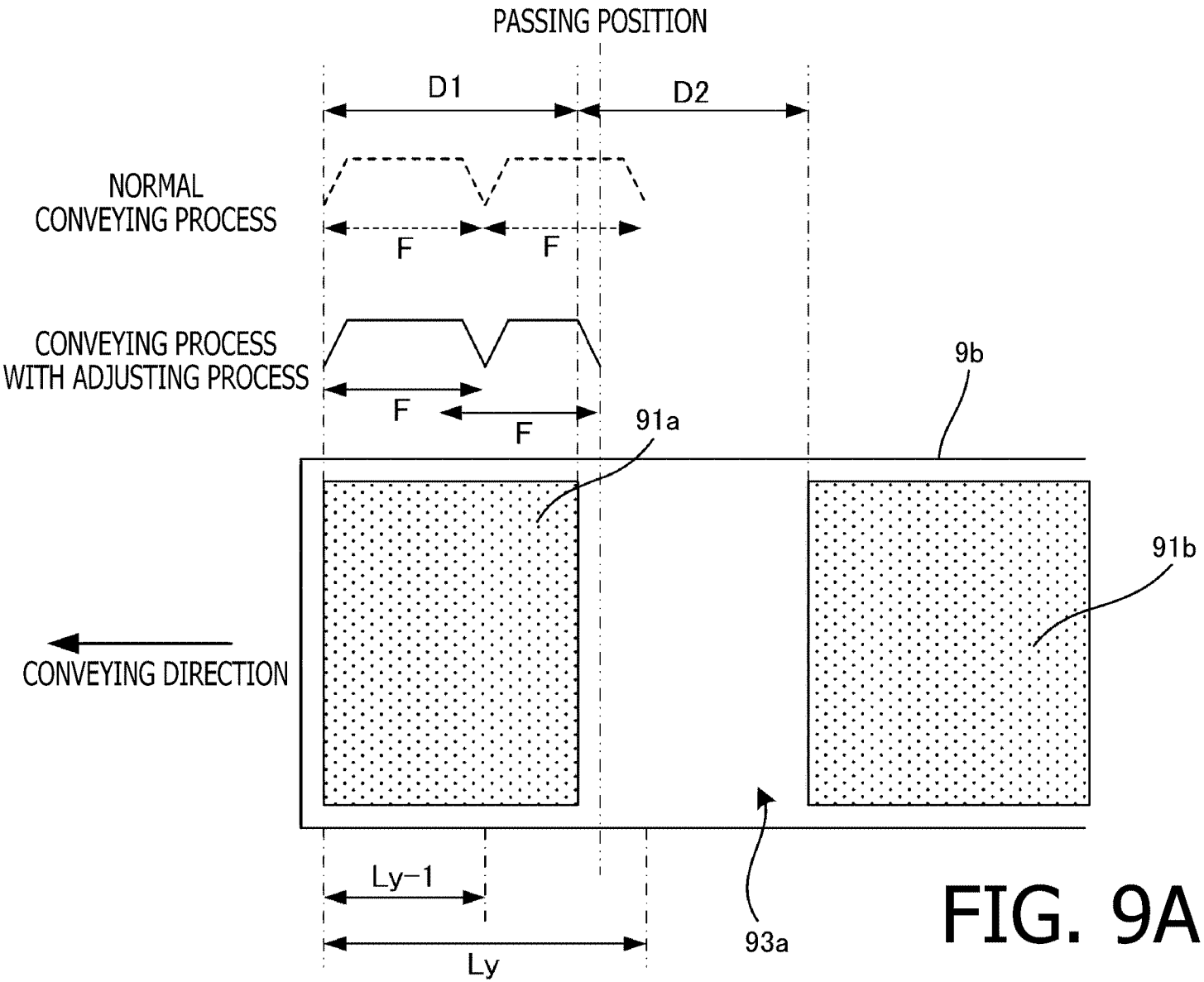

FIG. 9A illustrates an adjusting process within an image forming area arranged on a front side of a non-image area when prefetch of image data cannot be performed.

Figure 9B:
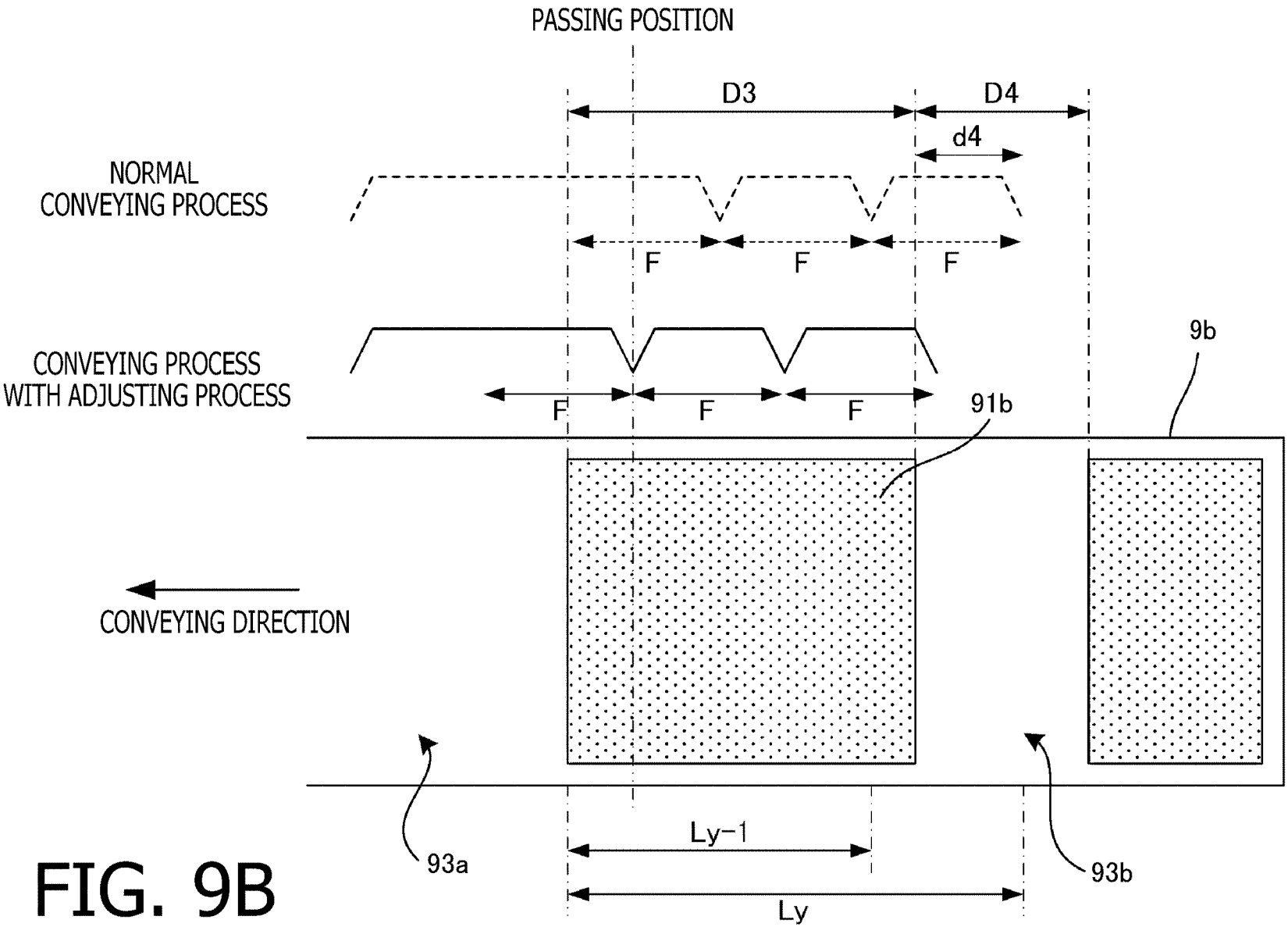

FIG. 9B illustrates an adjusting process within an image forming area arranged on a rear side of the non-image area when prefetch of image data cannot be performed.

Figure 10:
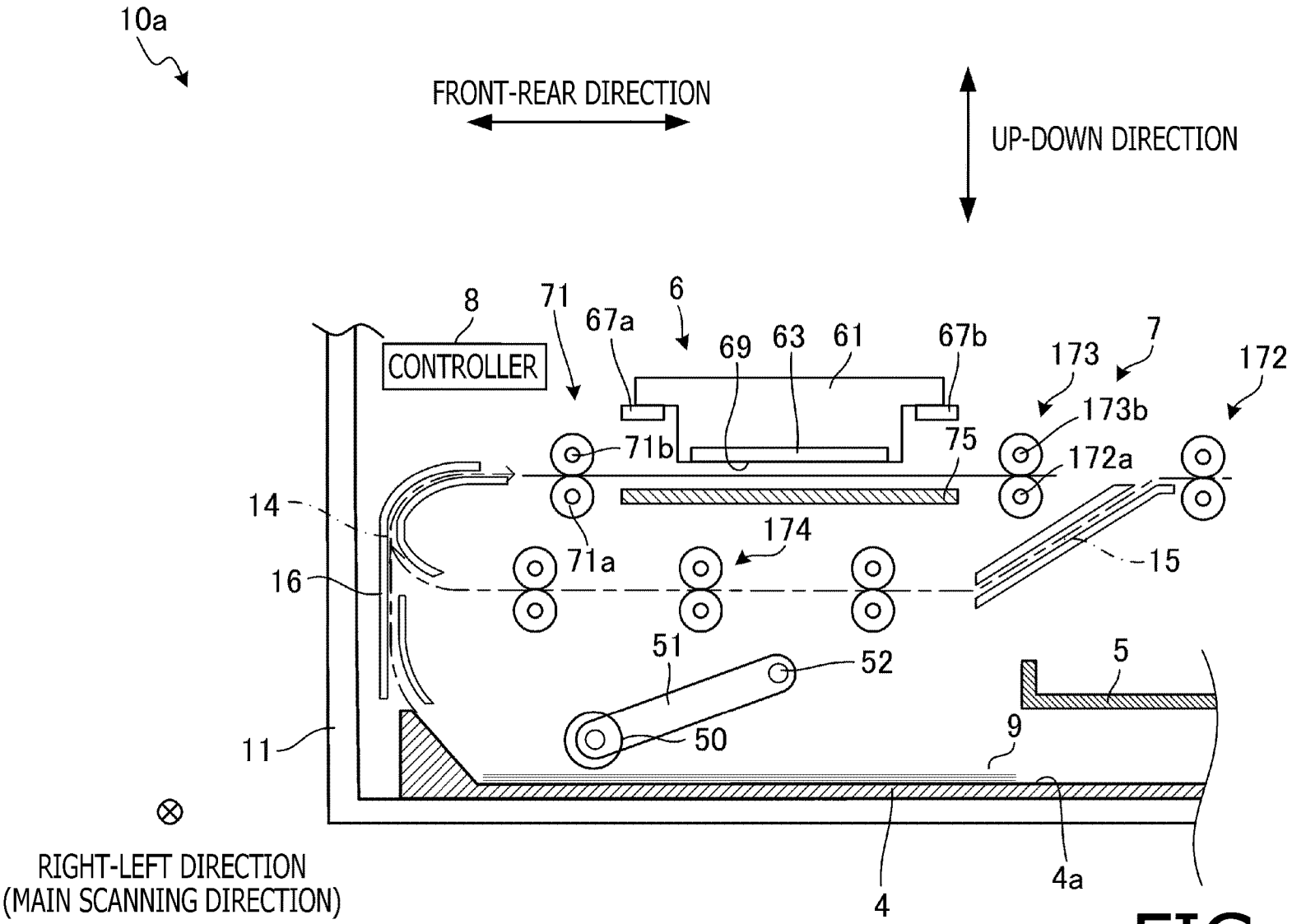

FIG. 10 schematically shows a side view of a printer according to a modification of the illustrative embodiment.

DETAILED DESCRIPTION OF THE EMBODIMENTS

Hereinafter, referring to the accompanying drawings, an inkjet printer (hereinafter, simply referred to as a "printer") 10 according to an illustrative embodiment will be described. In the following description, an up-down direction is defined with reference to a state where the printer 10 is usably installed (i.e., a state shown in FIG. 1), a front-rear direction is defined such that a side on which an opening 13 of a casing 11 is formed as a front side, and a right-left direction is defined as a direction when viewing the printer 10 from the front side.

As shown in FIG. 1, the printer 10 includes a sheet feed tray 4, a discharged sheet tray 5, a recorder 6, a conveyer 7 and a controller 8. The sheet feed tray 4, the recorder 6, the conveyer 7 and the controller 8 are accommodated in a casing 11 of the printer 10. Inside the casing 11, the sheet feed tray 4 is arranged below the recorder 6.

The sheet feed tray 4 is configured to accommodate a plurality of printing sheets 9 in a stacked manner. The sheet feed tray 4 is configured to be inserted and removed in the front-rear direction with respect to the casing 11. The sheet feed tray 4 has a sheet supporting surface 4*a* configured to support the printing sheet 9. At a rear end part of the sheet feed tray 4, an inclined plate 4*b* is provided.

The discharged sheet tray 5 is configured to accommodate the printing sheets 9 on which images are formed by a recording head 63 (described later) of the recorder 6. The discharged sheet tray 5 is arranged on an upper side of a front end part of the sheet feed tray 4 and is configured to move together with the sheet feed tray 4.

The recorder 6 includes a carriage 61 and the recording head 63. The carriage 61 is movably supported by two guide rails 67*a* and 67*b*. The two guide rails 67*a* and 67*b* are arranged to be spaced from each other in the front-rear direction, each extending in the right-left direction. The carriage 61 is arranged astride the two guide rails 67*a* and 67*b*. The carriage 61 is driven by a carriage driving motor 31 (see FIG. 2) to reciprocate in the right-left direction, which is a main scanning direction, along the two guide rails 67*a* and 67*b*.

The recording head 63 is mounted on the carriage 61, and reciprocates in the main scanning direction together with the carriage 61. The recording head 63 is configured to eject ink, which is supplied from an ink cartridge (not shown), through nozzles (not shown) formed on a nozzle surface 69 which is a bottom surface of the recording head 63 to record an image on the printing sheet 9. In the following description, an area facing a movable range of the nozzle surface 69 of the recording head 63 will be referred to as an image recording area F. That is, an image can be recorded on the printing sheet 9 located on the image recording area F by ink ejected from the nozzle surface 69 moving in the main scanning direction. A width of the image recording area F (i.e., a length of the image recording area F in a conveying direction of the printing sheet 9) will be represented by "W" (see FIG. 3B).

The conveyer 7 is configured to convey the printing sheet 9 inside the printer 10. The conveyer 7 includes a sheet feed roller 50, a conveying roller pair 71, a discharging roller pair 72, a platen 75 and a guide member 17.

The sheet feed roller 50 is arranged above the sheet feed tray 4. The sheet feed roller 50 is rotatably supported at one end portion of the arm 51. Another end portion, which is opposite to the portion supporting the sheet feed roller 50, of the arm 51 is supported by a shaft 52 which is fixed to the casing 11 and extends in the right-left direction such that the arm 51 is swingable about the shaft 52 within a plane perpendicular to the right-left direction. The arm 51 is urged, by a spring (not shown), such that the sheet feed roller 50 pushes the printing sheets 9 accommodated in the sheet feed tray 4, and the sheet feed roller 50 contacts the uppermost one of the printing sheets 9 accommodated in the sheet feed tray 4. The sheet feed roller 50 is configured to rotate, as the driving force of the sheet feed motor 33 (see FIG. 2) is transmitted, to feed rearward the uppermost printing sheet 9 from the sheet feed tray 4.

The conveying roller pair 71 and the discharging roller pair 72 are arranged on the rear side and the front side, respectively, with the recorder 6 being arranged therebetween. Specifically, the conveying roller pair 71 is arranged on the rear side with respect to the recorder 6, while the discharging roller pair 72 is arranged on the front side with respect to the recorder 6. The conveying roller pair 71 is configured to convey the printing sheet 9 toward the image recording area F. The discharging roller pair 72 is configured to receive the printing sheet 9 conveyed by the conveying roller pair 71, and discharge the same onto the discharged sheet tray 5. The platen 75 is arranged below the recorder 6 to face the nozzle surface 69 of the recorder 6.

The conveying roller pair 71 includes a driving roller 71*a* and a driven roller 71*b*. Similarly, the discharging roller pair 72 includes a driving roller 72*a* and a driven roller 72*b*. The driving roller 71*a* of the conveying roller pair 71 and the driving roller 72*a* of the discharging roller pair 72 are driven by a driving mechanism 35 which includes a single driving motor 35*a* (see FIG. 2). The driving mechanism 35 is configured to drive both the driving roller 71*a* and the driving roller 72*a* using the driving motor 35*a* as a driving source. The driving motor 35*a* is connected with a rotary encoder 21 (see FIG. 2) configured to detect a rotation angle of the driving motor 35*a*. The driven roller 71*b* and the driven roller 72*b* are driven to rotate as the driving rollers 71*a* and 72*a* rotate.

The conveying roller pair 71 is configured such that the driving roller 71*a* and the driven roller 71*b* nip the printing sheet 9 therebetween and convey the same. Similarly, the discharging roller pair 72 is configured such that the driving roller 72*a* and the driven roller 72*b* nip the printing sheet 9 therebetween and convey the same. In the following description, a position of the printing sheet 9 at which the driving roller 72*a* and the driven roller 72*b* of the discharging roller 72 nip the printing sheet 9 will be referred to as a "nipping position P."

The guide member 17 defines a conveying passage 14 through which the printing sheet 9 fed from the sheet feed tray 4 is conveyed toward the image recording area F. The guide member 17 extends from a position in the vicinity of the rear end part of the sheet feed tray 4 to a position in the vicinity of the conveying roller pair 71.

The printing sheet 9 fed rearward from the sheet feed tray 4 by the sheet feed roller 50 is directed to an obliquely upper direction by the inclined plate 4*b* provided to the rear end part of the sheet feed tray 4, passes through the conveying passage 14 defined by the guide member 17 and reaches a nipping position of the conveying roller pair 71. The printing sheet 9 nipped by the conveying roller pair 71 is conveyed frontward to the image recording area F by the conveying roller pair 71. The printing sheet 9 conveyed to the image recording area F by the conveying roller pair 71 is supported by the platen 75. Ink droplets are ejected from nozzles (not shown) of the recording head 63 moving in the main scanning direction, thereby an image is recorded on the printing sheet 9 supported by the platen 75. After the image is recorded on the printing sheet 9, the printing sheet 9 is conveyed frontward by the discharging roller pair 72 so as to be discharged onto the discharged sheet tray 5.

Figure 2:
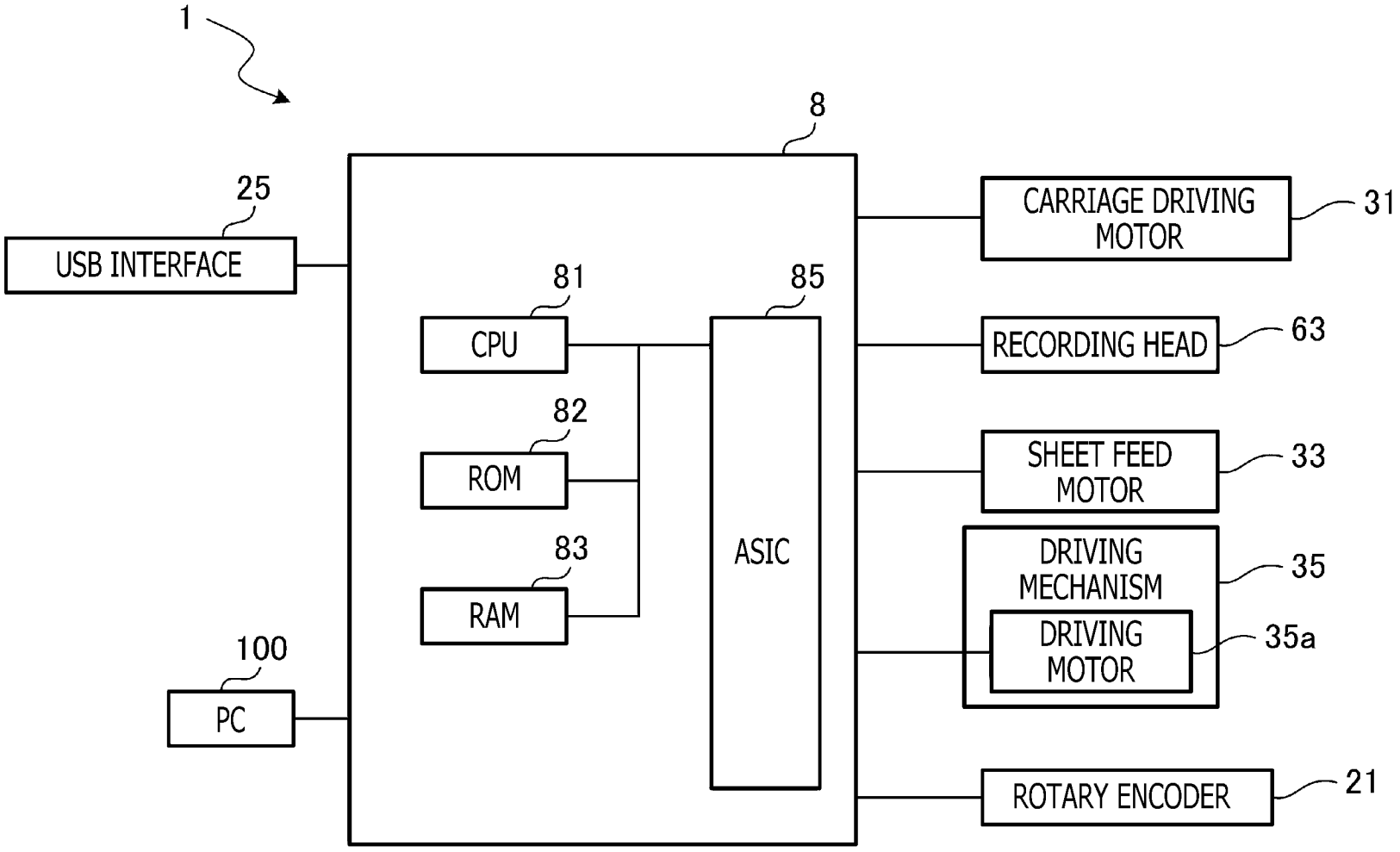
FIG. 2 is a block diagram of the printer shown in FIG. 1, which illustrates an electrical configuration thereof.

FIG. 2 indicates an electrical configuration 1 of the printer 10. The controller 8 controls the entire operation of the printer 10. As shown in FIG. 2, the carriage driving motor 31, the recording head 63, the sheet feed motor 33, the driving mechanism 35 and the rotary encoder 21 are electrically connected to the controller 8. Further, a USB interface 25 is electrically connected to the controller 8. The USB interface 25 is an interface compliant to the USB standard, and a USB memory, which serves as a removable memory, can be connected to the USB interface 25. Furthermore, a PC 100, which is an external device, can be connected to the controller 8.

The controller 8 includes a CPU 81, a ROM 82, a RAM 83 and an ASIC 85, which control, in association with each other, operations of the carriage driving motor 31, the recording head 63, the sheet feed motor 33 and the driving mechanism 35. According to the illustrative embodiment, the controller 8 obtains the image data from the USB memory connected to the USB interface 25 and/or PC 100, and temporarily stores the obtained image data in the RAM 83. It is noted that the RAM 83 is configured to simultaneously store image data to be recorded on at least two pages of the printing sheets 9.

It is noted that FIG. 2 shows one CPU 81 and one ASIC 85. Such a configuration may be modified such that, for example, the controller 8 includes only one CPU 81 (i.e., the controller 8 may not include the ASIC 85), and the CPU 81 operates to perform all the processes. Alternatively, the controller 8 may be configured to include a plurality of CPU's 81, which perform processes in a shared manner. Further, the controller 8 may include one ASIC 85 (i.e., the controller 8 may not include the CPU 81), which may perform all the processes. Alternatively, the controller 8 may include a plurality of ASIC's 85 which perform various processes in a shared manner.

The controller 8 controls driving of the sheet feed motor 33 such that, after a particular time period has elapsed since an n-th (n being an arbitrary natural number) printing sheet 9 was fed toward the image recording area, an (n+1)-th printing sheet 9 is fed toward the image recording area F.

The controller 8 controls driving of the driving motor 35*a* based on an output signal of the rotary encoder 21, and performs the conveying process to convey the printing sheet 9 using at least one of the conveying roller pair 71 or the discharging roller pair 72. FIG. 3A is a graph illustrating a relationship between a conveying speed V and a time T of the printing sheet 9 being conveyed by one of the conveying roller pair 71 or the discharging roller 72. When one conveying process is performed, the speed of the printing sheet, which is initially in a stationary state, gradually increases to reach a particular speed "V1." When the one conveying process is terminated, the speed of the printing sheet 9 decreases from the particular speed "V1" to the stationary state. Thus, as shown in FIG. 3A, one conveying process is divided into three periods including a "acceleration period" during which the conveying speed of the printing sheet 9 increases from "0" to "V1," a "constant speed period" during which the conveying speed V is kept to be "V1" and a "deceleration period" during which the conveying speed decreases from "V1" to "0."

Referring to FIG. 3B, the conveying process excluding an adjusting process of adjusting a conveying amount of the printing sheet 9 per one conveying process will be described. It is noted that the conveying process excluding the adjusting process will be referred to as a "normal conveying process" in the following description. In an example show in FIG. 3B, two image areas 91*a* and 91*b* within which images are to be recorded are arranged with being spaced from each other in the conveying direction. When the normal conveying process is performed, a conveying process of conveying the printing sheet 9 in the conveying direction is performed such that a downstream end of the image area 91*a* that is located at the most downstream side of the printing sheet 9 reaches a position identical to the downstream side end of the image recording area F in the conveying direction.

In a conveying process performed thereafter, assuming that the printing sheet 9 is conveyed by an amount "W" which is the same as the width of the image recording area F, when the image area 91*a* is located within the image recording area F, the conveying amount is determined to be a constant amount "W." That is, after the printing sheet 9 is conveyed such that the downstream end of the image area 91*a* reaches the position identical to the downstream side end of the image recording area F, as shown in FIG. 3B, if the image area 91*a* is included within an area adjoining, on the upstream side, to the image recording area F and having a length "W" in the conveying direction (in other words, if an upstream end of the image area 91*a* is located on a downstream side with respect to an upstream end of the area), the conveying amount is determined to be "W."

In contrast, assuming that the printing sheet 9 is conveyed by the amount "W" after the printing sheet 9 is conveyed such that the downstream end of the image area 91*a* reaches the position identical to the downstream side end of the image recording area F, if the image area 91*a* is not located within the image recording area F (in other words, if the upstream end of the image area 91*a* is located on an upstream with respect to an upstream end of the image recording area F), the printing sheet is further conveyed so that an downstream end, in the conveying direction, of the image area 91*b*, which is located on the upstream side in the conveying direction with respect to the image area 91*a* reaches to a position identical to a downstream end, in the conveying direction, of the image recording area F. Thereafter, if the image area 91*b* does not exist on the upstream side in the conveying direction with respect to the image recording area F, the printing sheet 9 is conveyed so that a trailing end of the printing sheet 9 coincides with a leading end (i.e., the downstream end), in the conveying direction, of the image recording area F. Further, a maximum value of the conveying speed V in the normal conveying process is "V1."

The controller 8 controls operations of the carriage driving motor 31 and the recording head 63 based on the image data stored in the RAM 83. When the conveying process is not performed, the controller 8 performs a scanning process in which the recording head 63 records an image on the printing sheet 9 while the carriage 61 moving in the main scanning direction. That is, as shown in FIG. 3A, by performing the conveying process and the scanning process alternately, recording of an image on one sheet of the printing sheet 9 is performed. It is noted that the scanning process is an example of a recording process.

Further, the controller 8 performs the adjusting process of adjusting a conveying amount of the printing sheet 9 subjected to the conveying process by controlling rotation of the driving motor 35*a* based on an output signal of the rotary encoder 21. The adjustment of the conveying amount in the adjusting process is performed such that, in case where images are to be recorded on a plurality of printing sheets 9, a timing when the trailing end, in the conveying direction (i.e., in the front-rear direction), of the n-th printing sheet 9 passes through the nipping position of the discharging roller pair 72 is within one of the acceleration period and the deceleration period of the conveying process for the printing sheet 9 (e.g., the deceleration period of the n-th printing sheet 9 or the acceleration period of the (n+1)-th printing sheet 9).

Specifically, the conveying amount in the adjusting process is controlled such that, at a timing when the conveying speed of the printing sheet 9 in the conveying process during the image is recorded on the (n+1)-th printing sheet 9 is equal to or less than a half of the maximum value (i.e., the speed V1 during the constant speed period) thereof, the trailing end of the n-th printing sheet 9 passes through the nipping position of the discharging roller pair 72. In the adjusting process, among a plurality of conveying processes performed within a period (which will be referred to as "conveying period") from a start of the conveying process for the n-th printing sheet 9 until a timing which is after a start of the conveying process for the (n+1)-th printing sheet 9 and before an end of the conveying process for the n-th printing sheet, the conveying amount of the printing sheet(s) 9 subject to at least one conveying process is adjusted.

When the adjustment of the conveying amount of the printing sheet 9 for one conveying process is performed, in the scanning processes which will be performed after the conveying process, positions of the printing sheet 9 facing respective nozzles of the recording head 63 are different from those of when the adjustment of the conveying amount for one conveying process is not performed. Therefore, when the adjusting process is performed, the operation of the recording head 63 is controlled such that an operation mode of ink ejection from respective nozzles (e.g., which nozzles are to be used) of the recording head 63 in the scanning processes performed thereafter is changed so that the same image could be printed on the same position on the printing sheet 9 as the positions when the adjusting process is not performed.

FIGS. 4A and 4B show a case where the n-th printing sheet 9*a* and the (n+1)-th printing sheet 9*b* are conveyed by the conveying roller pair 71 and the discharging roller pair 72. For each of the n printing sheets P, a plurality of the conveying processes are performed in accordance with, for example, a size of each image area on the printing sheet P, the number of the image areas or the like (hereinafter, each conveying process is also referred to as a "discharging pass"). FIGS. 4A and 4B show a state at a timing when an m-th conveying process has completed after the conveying processes for the n-th printing sheet 9 was started. By adjusting the conveying amount in the adjusting process so that the trailing end, in the conveying direction, of the printing sheet 9*a* passes through the nipping position P of the discharging roller 72 at the timing shown in FIGS. 4A and 4B, it becomes possible to convey the printing sheet 9*a* such that the trailing end of the printing sheet 9*a* passes through the nipping position P of the discharging roller pair 72 during the deceleration period of the m-th conveying process.

When the trailing end, in the conveying direction, of the printing sheet 9*a* is located in an upstream vicinity of the nipping position P of the discharging roller pair 72 at the timing shown in FIGS. 4A and 4B (i.e., at a timing when the m-th conveying process has completed), it becomes possible to convey the printing sheet 9*a* so that the trailing end, in the conveying direction, of the printing sheet 9*a* passes through the nip P of the discharging roller pair 72 during the acceleration period of an (m+1)-th conveying process. That is, by adjusting the conveying amount such that the trailing end thereof is located at the nipping position P (or the upstream vicinity of the nipping position P) of the discharging roller pair 72 at the timing when the m-th conveying process is completed, it is possible to convey the printing sheet 9*a* such that the trailing end of the printing sheet 9*a* passes through the nipping position P of the discharging roller pair 72 during the accelerating period or the decelerating period of the printing sheet 9 in one conveying process.

It is assumed that a distance between the conveying roller pair 71 and the discharging roller pair 72 is represented by X, and a distance between the trailing end, in the conveying direction, of the n-th printing sheet 9*a* and the leading end, in the conveying direction, of the (n+1)-th printing sheet 9*b* is represented by L. It is further assumed that a distance between the leading end of the printing sheet 9*b* and the conveying roller pair 71 at a timing when the m-th conveying process has completed is represented by Am (which will be referred to as a following sheet conveying distance). If X=L+Am, the trailing end of the printing sheet 9*a* is located at the nip P of the discharging roller pair 72 at a timing when the m-th conveying process has completed. Therefore, by adjusting the conveying amount of the printing sheet 9 subjected to the conveying process to meet the equation X=L+Am, it becomes possible that the trailing end, in the conveying direction, of the printing sheet 9*a* passes through the nipping position P of the discharging roller pair 72 during one of the acceleration period and the deceleration period of the printing sheet 9 in one conveying process.

First Method: Adjustment of L (1)

Hereinafter, referring to FIGS. 5A and 5B, as a first method of the adjusting process, an example to realize the equation X=L+Am by adjusting the distance L between the printing sheets 9 will be described. In the example described below, it is assumed that the image data to be recorded on the n-th printing sheet 9*a* and the (n+1)-th printing sheet 9*b* has already been stored in the RAM 83. According to this configuration, before starting recording of an image on the n-th printing sheet 9*a*, it is possible to perform prefetch of an image to be recorded on the (n+1)-th printing sheet 9*b*.

FIGS. 5A and 5B show the n-th printing sheet 9*a* during a before-reaching period which is within the conveying period (i.e., after a start of the conveying process for the n-th printing sheet 9) and before the (n+1)-th printing sheet 9*b* reaches the conveying roller pair 71. As shown in FIGS. 5A and 5B, the printing sheet 9*a* includes an image area 91*a* in which an image is recorded, and a non-image area 93. The non-image area 93 is defined to adjoin the image area 91*a* on the upstream side in the conveying direction, and no image is recorded over an entire width of the non-image area 93 in the main scanning direction.

In the adjusting process, as shown in FIG. 5A, the distance L between the printing sheets 9 is adjusted by adjusting the conveying amount in the conveying process which is performed within a period in which both the image area 91*a* and the non-image area 93 are within the image recording area F.

According to the normal conveying process (i.e., the conveying process excluding the adjusting process), when a next conveying process is performed in a state shown in FIG. 5A, since the image area 91*b* is not located on the upstream side with respect to the image recording area F, as mentioned above, the printing sheet 9*a* is conveyed until the trailing end of the printing sheet 9*a* coincides with the leading end (i.e., the upstream end in the conveying direction) of the image recording area F as shown in broken lines in FIG. 5B.

In contrast, when the adjusting process is performed, the printing sheet 9*a* is not conveyed until the trailing end of the printing sheet 9*a* coincides with the leading end of the image recording area F. In that case, the conveying amount is lessened in comparison with the normal conveying process so that conveyance of the printing sheet 9*a* is interrupted in a state as indicated by solid lines in FIG. 5B.

At this time (i.e., if the adjusting process is performed), the conveying speed during the constant speed period is set to "V2" slower than the conveying speed V1 of the normal conveying process so that a processing time of the conveying process (i.e., the time it takes the printing sheet 9*a* to be a state indicated by the solid lines in FIG. 5B at the speed V2) is the same as a processing time of the normal conveying process (i.e., the time it takes the printing sheet 9*a* to be a state indicated by the broken lines in FIG. 5B at the speed V1). By performing the adjusting process, the distance L between the n-th printing sheet 9*a* and the (n+1)-th printing sheet 9*b* which is fed, by a particular time period, after the n-th printing sheet 9*a* was fed can be shortened in comparison with a case where the normal conveying process is performed.

The above-described adjusting process could be applied, when the trailing end, in the conveying direction, of the image area 91*a* is located within the image recording area F, if the other image area 91*b* which is different from the image area 91*a* or the upstream side end, in the conveying direction, of the printing sheet 9 is not located within an area adjoining the image recording area F on the upstream side and having the length "W" in the conveying direction.

Second Method: Adjustment of L (2)

Hereinafter, referring to FIGS. 6A and 6B, as a second method of the adjusting process, an example to realize the equation X=L+Am by adjusting the distance L between the printing sheets 9 will be described. In the example described below, it is assumed that the image data to be recorded on the n-th printing sheet 9*a* and the (n+1)-th printing sheet 9*b* has already been stored in the RAM 83. According to this configuration, before starting recording of an image on the n-th printing sheet 9*a*, it is possible to perform prefetch of an image to be recorded on the (n+1)-th printing sheet 9*b*.

FIGS. 6A and 6B show the n-th printing sheet 9*a* during a before-reaching period which is within the conveying period (i.e., after a start of the conveying process for the n-th printing sheet 9) and before the (n+1)-th printing sheet 9*b* reaches the conveying roller pair 71. As shown in FIGS. 6A and 6B, the printing sheet 9*a* includes an image area 91*a*.

In the example shown in FIG. 6A, the distance L between the printing sheets 9 is adjusted, in the adjusting process, by adjusting the conveying amount in the conveying process to be performed within a period in which the leading end, in the conveying direction, of the image area 91*a* is located within the image recording area F.

For example, it is assumed that a position of the leading end (the downstream end) of the image area 91*a* at a time when the first conveying process has completed in the normal conveying process (i.e., the conveying process excluding the adjusting process) is, as shown by broken lines in FIG. 6A, a position identical to the leading end, in the conveying direction, of the image recording area F.

In this case, it is further assumed that the conveying amount in the first conveying process is lessened in comparison with the conveying amount in the normal conveying process by performing the adjusting process, thereby the position of the printing sheet 9*a* at a time when the first conveying process has completed is, as shown by thick solid lines in FIG. 6A, a position at which the leading end of the image area 91*a* is located at about a center of the image recording area F in the conveying direction.

At this time (i.e., If the adjusting process is performed), the conveying speed during the constant speed period is set to "V3" slower than the conveying speed V1 of the normal conveying process so that a processing time of the conveying process is the same as a processing time of the normal conveying process. By performing the adjusting process, the distance L between the n-th printing sheet 9*a* and the (n+1)-th printing sheet 9*b* which is fed, by a particular time period, after the n-th printing sheet 9*a* was fed can be shortened in comparison with a case where the normal conveying process is performed.

In the example shown in FIG. 6B, the distance L between the printing sheets 9 is adjusted, in the adjusting process, by adjusting the conveying amount in the conveying process to be performed within a period in which the trailing end, in the conveying direction, of the image area 91*a* is located within the image recording area F.

For example, it is assumed that a position of the trailing end (i.e., the upstream end) of the image area 91*a* at a time when a k-th conveying process has completed in the normal conveying process excluding the adjusting process is located at about the center, in the conveying direction, of the image recording area F, as shown in broken lines in FIG. 6B.

In this case, it is further assumed that the conveying amount in the k-th conveying process is lessened in comparison with the conveying amount in the normal conveying process by performing the adjusting process, thereby the position of the printing sheet 9*a* at a time when the k-th conveying process has completed is, as shown by thick solid lines in FIG. 6B, a position at which the trailing end of the image area 91*a* coincides with the rear end of the image recording area F in the conveying direction.

At this time (i.e., If the adjusting process is performed), the conveying speed during the constant speed period is set to "V4" slower than the conveying speed V1 of the normal conveying process so that a processing time of the conveying process is the same as a processing time the normal conveying process. By performing the adjusting process, the distance L between the n-th printing sheet 9*a* and the (n+1)-th printing sheet 9*b* which is fed, by a particular time period, after the n-th printing sheet 9*a* was fed can be shortened in comparison with a case where the normal conveying process is performed.

Third Method: Adjustment of Am

Hereinafter, referring to FIG. 7, as a third method of the adjusting process, an example to realize the equation X=L+

Am by adjusting the following sheet conveying distance Am will be described. In the example described below, it is assumed that the image data to be recorded on the n-th printing sheet 9*a* and the (n+1)-th printing sheet 9*b* has already been stored in the RAM 83. According to this configuration, before starting recording of an image on the n-th printing sheet 9*a*, it is possible to perform prefetch of an image to be recorded on the (n+1)-th printing sheet 9*b*.

FIG. 7 shows the n-th printing sheet 9*a* during a post-reaching period which is within the conveying period (i.e., before an end of the conveying process for the n-th printing sheet) and after the (n+1)-th printing sheet 9*b* reached the conveying roller pair 71. As shown in FIG. 7, the printing sheet 9*a* includes, from the downstream side along the conveying direction in order, the image area 91*a*, a non-image area 93 and the image area 91*b*. That is, the image area 91*a* is located on the downstream side of the printing sheet 9*b*, the image area 91*b* is located on the upstream side of the printing sheet 9*b*, and the non-image area 93 is located between the image area 91*a* and the image area 91*b* in the conveying direction. It is assumed that a length of the non-image area 93 along the conveying direction is "d2."

FIG. 7 also shows a case where the (m−1)-th conveying process of the printing sheet 9*b* has completed and before the m-th conveying process is performed. In the example shown in FIG. 7, after the (m−1)-th conveying process has been performed, the trailing end of the image area 91*a* coincides with the rear end of the image recording area F. Therefore, when the m-th conveying process is performed, the non-image area 93 located on the upstream side, in the conveying direction, with respect to the image area 91*a* is conveyed within the image recording area F.

In this case, if the normal conveying process is performed, by the m-th conveying process, the printing sheet 9 is conveyed such that the downstream side end, in the conveying direction, of the image area 91*b* coincides with the downstream end of the image recording area F in the conveying direction. That is, the conveying amount of the m-th conveying process is "d2+W."

As shown in FIG. 7, at a time when the (m−1)-th conveying process has completed, a length from the upstream side end of the n-th printing sheet 9*a* to the nipping position P of the discharging roller pair 72 is "d1." If d1<d2 is fulfilled, by setting the conveying amount in the m-th conveying process to "d1" by the adjusting process, the conveying amount is less than the conveying amount in the normal conveying process. With this adjustment, the following sheet conveying distance Am which is a distance from the leading end of the printing sheet 9*b* to a conveying termination position on the printing sheet 9*b* (i.e., a position of the printing sheet 9*b* nipped by the conveying roller pair 71 when the m-th conveying process has completed) can be shortened in comparison with a case where the normal conveying process is performed.

In the foregoing, a case where the adjusting process is performed for the m-th conveying process, and the trailing end of the n-th printing sheet is located in the vicinity of the nipping position P of the discharging roller pair 72 at a time when the m-th conveying process has completed is described as an example. It is noted that the conveying process subject to the adjusting process may be the conveying process performed before the conveying process (i.e., the m-th conveying process) to convey the trailing end of the n-th printing sheet 9 to a position in the vicinity of the nipping position P of the discharging roller pair 72.

Hereinafter, referring to a flowchart shown in FIG. 8, an exemplary process performed by the controller 8 will be described. Firstly, a variable "n" which represents the number of order of the printing sheets 9 is initialized (i.e., set to one) (S1). Next, the controller 8 retrieves the image data stored in the USB memory connected to the USB interface 25 or the PC 100, and stores the same in the RAM 83 (S2). In S3, the controller 8 determines whether the image data subject to be printed on the (n+1)-th printing sheet 9 is stored in the RAM 83. When it is determined that the image data subject to be printed on the (n+1)-th printing sheet 9 is stored in the RAM 83 (S3: YES), based on two pieces of the image data for the n-th and (n+1)-th printing sheets, the controller 8 calculates what number of order of the conveying process during the conveying period is the conveying process (i.e., the discharging pass) in which the n-th printing sheet 9 passes through the nipping position P of the discharging roller pair 72 and discharged from the printer 10, and set the variable "m" to the calculated number of order (S4). That is, the n-th printing sheet 9 passes through the nipping position P in the m-th conveying process (i.e., the m-th discharging pass) among a plurality of conveying processes during the conveying process of the n-th printing sheet, thereby the n-th printing sheet 9 is discharged from the printer 10.

Next, the controller 8 determines whether or not a timing when the n-th printing sheet 9*a* passing through the nipping position P of the discharging roller 72 and discharged from the printer 10 is within one of the acceleration period and the deceleration period of the m-th conveying process (S5). When it is determined that the timing is not in the acceleration period or the deceleration period (S5: NO), that is, when it is determined that the n-th printing sheet 9*a* passes through the nipping position P of the discharging roller pair 72 within the constant speed period, according to one of the first through three methods described above, the controller 8 calculate a conveying amount in at least one conveying process among a plurality of conveying processes to be performed within the conveying period of the printing sheet 9 such that the equation X=L+Am is satisfied after execution of the plurality of conveying processes (S6). The conveying amount of the at least one conveying process is change to the calculated conveying amount from a conveying amount of the normal conveying process in S8 which will be explained below.

For example, when the condition X=L+Am cannot be satisfied simply by changing the conveying amount for one conveying process performed within the conveying period, the conveying amounts for a plurality of conveying processes to be performed within the conveying period may be changed by combining the first through third methods described above.

Next, the controller 8 determines whether the number of scanning processes performed within the conveying process is changed if the adjusting process to change the conveying amount of the printing sheet 9 subject to at least one conveying process of the plurality of conveying processes performed within the conveying period to the conveying amount calculated in S6 is performed (S7). That is, the controller 8 calculates the numbers of scanning processes performed within the conveying period when the adjusting process is performed and when the adjusting process is not performed, and compare the same to determine whether the number of the scanning processes is changed.

When it is determined that the number of the scanning processes is unchanged by performing the adjusting process(es) (S7: NO), the controller performs the adjusting process(es). That is, the conveying amount of the printing sheet 9 subject to at least one conveying process among the plurality of conveying processes performed during the conveying period is changed to the changed conveying amount calculated in S6.

When it is determined that the number of the scanning processes is changed by performing the adjusting process(es) (S7: YES), S8 is skipped. Thereafter, the conveying processes and the scanning processes are performed alternately to record the image on the n-th printing sheet 9 (S9).

In S5, when it is determined that the n-th printing sheet 9 passes through the nipping position P of the discharging roller pair 72 during one of the acceleration period and the deceleration period (S5: YES), the processes of S6-S8 are skipped.

Next, in S10, the variable n is incremented by one (n=n+1) and the controller 8 determines whether the image data subject to be recorded on the (n+1)-th printing sheet 9 is stored in the RAM 83 (S11). When it is determined that the image data subject to be recorded on the (n+1)-th printing sheet 9 is stored in the RAM 83 (S11: YES), the controller 8 returns to S4. When it is determined that the image data subject to be recorded on the (n+1)-th printing sheet 9 is not stored in the RAM 83 (S11: NO), the controller 8 returns to S2.

When it is determined that the image data subject to be recorded on the (n+1)-th printing sheet 9 is not stored in the RAM 83 (S3: NO), the controller 8 performs recording of the image on the n-th printing sheet (S12) and terminates the process shown in FIG. 8.

As described above, the printer 10 according to the illustrative embodiment is configured to perform the conveying process of conveying the printing sheet 9 using at least one of the conveying roller pair 71 and the discharging roller pair 72, the scanning process of moving the carriage 61 in the main scanning direction and recording the image on the printing sheet 9 with the recording head 63 when the conveying process is not performed, and the adjusting process. In the adjusting process, among a plurality of conveying processes performed within a period from the start of the conveying process for the n-th printing sheet 9 until the timing which is after the start of the conveying process for the (n+1)-th printing sheet 9 and before the end of the conveying process for the n-th printing sheet, the conveying amount of the printing sheet 9 subject to at least one conveying process is adjusted such that a timing when the trailing end of the n-th printing sheet 9 passes through the nipping position P of the discharging roller pair 72 is within one of the acceleration period and the deceleration period of the conveying process for the printing sheet 9.

When one conveying process is performed, the printing sheet 9 is not conveyed at the constant speed from the beginning of the conveying process. That is, initially, the printing sheet 9 in the stationary state (i.e., the conveying speed is zero). The conveying speed is gradually increased in the acceleration period and then reaches the particular speed (i.e., the constant speed). Further, when one conveying process is terminated, the printing sheet 9 is not stopped abruptly. The conveying speed is gradually decreased from the particular speed in the deceleration period and then reaches zero (i.e., the stationary state). By adjusting the conveying amount of the printing sheet 9 subject to at least one conveying process among the plurality of conveying processes performed within the conveying period, the trailing end, in the conveying direction, of the printing sheet 9 passes through the nipping position P of the discharging roller pair 72 within one of the acceleration period and the deceleration period of the conveying process of the printing sheet 9. Therefore, even if the constant speed is not lowered, the speed of the printing sheet 9 when passing through the nipping position P of the discharging roller pair 72 is relatively low. Accordingly, it is possible to make the printing sheets 9 be stacked on the discharged sheet tray 5 in well-aligned manner with suppressing lowering of the throughput of printing images.

According to the printer 10 described above, the controller 8 compares the numbers of the scanning processes performed within the conveying period when the adjusting process is performed and when the adjusting process is not performed. Then, only when the numbers of the scanning processes in both cases are the same, the controller 8 performs the adjusting process. Therefore, lowering of the throughput of printing images can further be suppressed.

Further, in the printer 10 describe above, the controller 8 adjusts, in the adjusting process, the conveying amount of the printing sheet 9 subject to one or more conveying processes during the before-reaching period which is within the conveying period and before the (n+1)-th printing sheet 9 to be conveyed by the conveying roller 71 reaches the conveying roller pair 71.

Accordingly, it is possible to change the distance L between the trailing end of the n-th printing sheet 9*a* and the leading end of the (n+1)-th printing sheet 9*b* (c.f., the first method and the second method).

Further, according to the printer 10 described above, the controller 8 is configured to adjust the conveying amount of the n-th printing sheet 9*a* in the conveying process(es) performed within the period in which the non-image area 93, in which no image is formed over the entire width in the main scanning direction, is located in the image recording area F (c.f., the first method). Therefore, it is guaranteed that the number of scanning processes will not be increased.

According to the printer 10 described above, the controller 8 is configured to adjust, in the adjusting process, the conveying amount in the conveying process(es) performed within a period in which the printing area 91, in which the image is recorded, of the n-th printing sheet 9*a* is located within the image recording area F (c.f., the second method). Accordingly, even if there is no non-image area 93 on the printing sheet 9*a*, the adjusting process can be performed.

According to the printer 10 described above, the controller 8 adjusts the conveying amount and the conveying speed in the conveying process which is performed within a period in which the non-image area 93 or the image area 91 is located within the image recording area F (c.f., the first method and the second method). Accordingly, by keeping the period necessary for performing the conveying process from changing in association with variation of the conveying amount, it becomes possible to avoid adjustment of the sheet feed timing of the following printing sheet 9.

Further, according to the printer 10 described above, the controller 8 adjusts, in the adjusting process, the conveying amount of the printing sheet 9 of one or more conveying processes during the post-reaching period, which is the period within the conveying period and after the (n+1)-th printing sheet 9*b*, which is conveyed by the conveying roller pair 71 has reached the conveying roller pair 71 (c.f., the third method). Accordingly, it is possible to change the following sheet conveying distance Am (i.e., a distance from the leading end of the (n+1)-th printing sheet 9*b* to the conveying termination position on the (n+1)-th printing sheet 9*b*).

Further, according to the printer 10 described above, the controller 8 adjusts the conveying amount in the conveying process which is performed during a period in which the non-image area 93 in which no image is formed over the entire width in the scanning direction of the (n+1)-th printing sheet 9*b* is located within the image recording area F (c.f., the third method). Such an adjusting process is applicable when the prefetch of the image data can be performed.

Furthermore, according to the printer 10 described above, the controller 8 performs the adjusting process, based on an output signal from the rotary encoder 21 configured to detect a rotation angle of the driving motor 35*a*, such that the trailing end, in the conveying direction, of the n-th printing sheet 9 passes through the nipping position P of the discharging roller pair 72 at a timing when the conveying speed of the printing sheets 9 in the conveying process when the image is recorded on the (n+1)-th printing sheet 9 is equal to or less than a half of the maximum value of the conveying speed. Accordingly, it is possible to ensure that the discharged printing sheets 9 are stacked on the discharged sheet tray 5 in a well-aligned manner.

In the description above, the illustrative embodiment is described, referring to the accompanying drawings. It should be noted that concrete configurations according to aspects of the present disclosures need not be limited to the above-described embodiment. That is, aspects of the present disclosures should include configurations equivalent to those set forth in the claims and every possible modifications thereof.

According to the embodiment described above, it is assumed that the image data subject to be recorded on the printing sheets 9*a* and 9*b* have already been stored in the RAM 83. However, aspects of the present disclosures need not be limited such configurations.

Hereinafter, the adjusting process applicable to a configuration in which only part of the image data to be recorded on the printing sheet 9 is stored in the RAM 83 will be described with reference to FIGS. 9A and 9B. In such a case, the distance L between the printing sheets 9 is adjusted to meet the equation X=L+Am.

FIGS. 9A and 9B show the (n+1)-th printing sheet 9*b* conveyed by the conveying roller pair 71 when the trailing end of the n-th printing paper 9 passes through the nipping position P of the discharging roller pair 72. In each of FIGS. 9A and 9B, on an upper side with respect to a figure indicating the printing sheet 9*b*, it is indicated, by broken lines, that the conveying speed when the printing sheet 9*b* passes through the rear end, in the conveying direction, of the image recording area F when the normal conveying processes are performed, and a range of the image recording area F in the scanning process performed after each of the conveying processes. Further, on the upper side with respect to the figure indicating the printing sheet 9*b*, it is indicated, by solid lines, that the conveying speed when the printing sheet 9*b* passes through the rear end, in the conveying direction, of the image recording area F when the conveying processes with the adjusting processes are performed and a range of the image recording area F in the scanning process performed after each of the conveying processes. Furthermore, a position, on the printing sheet 9*b*, passing through the rear end of the image recording area F when the trailing end of the preceding n-th printing sheet 9*a* passes through the nipping position P of the discharging roller pair 72 (hereinafter, referred to as "passing position") is indicated by two-dotted lines.

As shown in FIG. 9A, on the (n+1)-th printing sheet 9*b*, there is an image area 91*a* on the front side (i.e., the downstream side), in the conveying direction, with respect to the non-image area 93*a*. For the purpose of description, a length of the image area 91*a* along the conveying direction is represented by D1 and a length of the non-image area 93*a* along the conveying direction is represented by D2. Further, a length from the leading end of the image area 91*a* to the rear end of the image recording area F along the conveying direction at a time when a y-th conveying process has completed when the normal conveying process is performed and the image area 91*a* is conveyed to the image recording area F is represented by Ly. Then, the length D1 of the image area 91*a* and the length D2 of the non-image area 93*a* satisfy conditions:

$$Ly-1<D1<Ly; \text{ and}$$

$$D1+D2>Ly.$$

The adjusting process according to the present modification is applicable when it is known from the image data store in the RAM 83 that the above-described image area 91*a* and non-image area 93*a* are included in the (n+1)-th printing sheet 9*b*.

As indicated by the two-dotted lines in FIG. 9A, the passing position is located in the non-image area 93*a*. As indicated by the broken lines in FIG. 9A, when the normal conveying process is performed, the preceding n-th printing sheet 9*a* passes through the nipping position P of the discharging roller pair 72 in the constant speed period of the second conveying process of conveying the image area 91*a* to the image recording area F. It is noted that the number "second" of the second conveying process is the number when it is counted from the y-th conveying process, and the second conveying process is the (y+2)-th conveying process in the entire process. At a time when the second conveying process has completed, the rear end, in the conveying direction, of the image recording area F is located in the non-image area 93*a*. Therefore, as indicated by solid lines in FIG. 9A, the adjusting process is performed so that the conveying amount in the second conveying process to convey the image area 91*a* to the image recording area F is smaller than the conveying amount in the normal conveying process. Specifically, the adjusting process is performed with respect to the second conveying process so that the rear end, in the conveying direction, of the image recording area F coincides with the passing position at the time when the second conveying process has completed. Accordingly, the following sheet conveying distance Am from the leading end of the printing sheet 9*b* to the nipping position P of the conveying roller pair 71 when the second conveying process has completed is shorter in comparison with the same when the normal conveying process is performed.

As shown in FIG. 9B, on the (n+1)-th printing sheet 9*b*, there exists an image area 91*b* on the rear side (i.e., the upstream side), in the conveying direction, with respect to the non-image area 93*a*. Further, on the rear side, in the conveying direction, with respect to the image area 91*b*, there exists the non-image area 93*b*. For the purpose of description, a length of the image area 91*b* along the conveying direction is represented by D3 and a length of the non-image area 93*b* along the conveying direction is represented by D4. Further, a length from the leading end of the image area 91*b* to the rear end of the image recording area F along the conveying direction at a time when a y-th conveying process has completed when the normal conveying process is performed and the image area 91*a* is conveyed to the image recording area F is represented by Ly. Then, the length D3 of the image area 91*b* and the length D4 of the non-image area 93*b* satisfy conditions:

$$Ly-1<D3<Ly; \text{ and}$$

$$D3+D4>Ly.$$

The adjusting process according to the present modification is applicable when it is known from the image data store in the RAM 83 that the above-described image area 91*b* and non-image area 93*b* are included in the (n+1)-th printing sheet 9*b*.

As indicated by two-dotted lines in FIG. 9B, the passing position is in the image area 91*b*. Further, as indicated by broken lines in FIG. 9B, when the normal conveying process is performed, the preceding n-th printing sheet 9*a* passes through the nipping position P of the discharging roller pair 72 in the constant speed period of the first conveying process for conveying the image area 91*b* to the image recording area F. Further, at a time when the third conveying process has completed, the rear end, in the conveying direction, of the image recording area F is located in the non-image area 93*b*. A length from the rear end, in the conveying direction, of the image recording area F to the trailing end, in the conveying direction, of the image area 91*b* at a time when the third conveying process has completed (hereinafter, referred to as a "protruding length") is d4.

In the adjusting process, as indicated by solid lines in FIG. 9B, the conveying amount in the first conveying process to convey the image area 91*b* to the image recording area F is smaller than the conveying amount in the normal conveying process. Specifically, the controller 8 performs the adjusting process with respect to the first conveying process so that the rear end, in the conveying direction, of the image recording area F coincides with the passing position at the time when the first conveying process has completed. Accordingly, the following sheet conveying distance Am from the leading end of the printing sheet 9*b* to the conveying roller pair 71 at the time when the first conveying process has completed is shorter than the same when the normal conveying process is performed.

If an amount to be reduced from the conveying amount in the normal conveying process when the adjusting process is performed is equal to or less than the protruding length d4, the number of scanning processes performed within the conveying period by performing the adjusting process is the same as the number of times when the adjusting process is not performed.

In the description above, a case where the discharging roller pair 72 configured to discharge the printing sheet 9 onto the discharged sheet tray 5 receives the printing sheet 9 conveyed by the conveying roller pair 71 is described. However, aspects of the present disclosures need not be limited to such a configuration.

For example, in a printer 10*a* shown in FIG. 10, a conveying roller pair 173 is arranged between the recorder 6 and a discharging roller pair 172 configured to discharge the printing sheet 9 onto the discharge sheet tray 5, and the conveying roller pair 173 is configured to receive the printing sheet 9 conveyed by the conveying roller pair 71. In this configuration, a driving motor 35*a*, which outputs the driving force to be applied to the conveying roller pair 173 and the discharging roller pair 172, is configured to rotate forwardly/reversely.

In the printer 10*a* shown in FIG. 10, image recordation is performed with forwardly conveying the printing sheet 9, which is to be fed from the sheet feed tray 4 toward the image recording area F, with use of at least one of the conveying roller pair 71, the conveying roller pair 173 and the discharging roller pair 172. When the trailing end of the printing sheet 9 has been conveyed in the vicinity of the discharging roller pair 172, the driving motor 35*a* is reversely rotated so that the printing sheet 9 is sent to a reverse passage 15 extending, from the vicinity of the discharging roller pair 172, below the recorder 6. That is, the discharging roller pair 172 has a function of a switch-back roller.

The reverse passage 15 is located between the recorder 6 and the sheet feed tray 4 and extends in the front-rear direction. The printing sheet 9 introduced in the reverse passage 15 is conveyed rearward, below the recorder 6, by a plurality of conveying roller pairs 174 and further introduced in the conveying passage 14 extending from the sheet feed tray 4 to the recorder 6 on a rear side of the printer 10*a*. In other words, the reverse passage 15 converges with the conveying passage 14 on the rear side of the printer 10*a*.

On one surface of the printing sheet 9 introduced from the reverse passage 15 to the conveying passage 14, an image has been recorded. The printing sheet 9 is further conveyed to the image recording area F through the conveying passage 14 with a surface opposite to the one surface on which the image has been recorded being faced the nozzle surface 69 of the recording head 63, thereby images being recorded on both surfaces of the recording sheet 9. The recording sheet 9 of which images are recorded on both surfaces is discharged on the discharged sheet tray 5 by the discharging roller pair 172.

In the printer 10*a* as shown in FIG. 10, the controller 8 performs the adjusting process so that a timing when a trailing end of the n-th printing sheet 9 subject to the image recordation is passes through the discharging roller pair 172 is within in the accelerating period or the decelerating period of the conveying process for the printing sheet.

In the above-described embodiment, description is made in a case where the (n+1)-th printing sheet 9*b* is conveyed by the conveying roller pair 71 when the trailing end, in the conveying direction, of the n-th printing sheet 9*a* passes through the nipping position P of the discharging roller pair 72. However, aspects of the present disclosures should not be limited to such a configuration. For example, when the trailing end, in the conveying direction, of the n-th printing sheet 9*a* passes through the nipping position P of the discharging roller pair 72, the sheet conveyed by the conveying roller pair 71 may be an (n+x)-th printing sheet (x being an arbitrary natural number).

Further, in the above-described embodiment, description is made in a case where the adjusting process is performed such that the trailing end, in the conveying direction, of the n-th printing sheet 9 passes through the nipping position P of the discharging roller pair 72 at a timing when the conveying speed of the printing sheet 9 in the conveying process when an image is recorded on the (n+1)-th printing sheet 9 is equal to or less than a half of the maximum value thereof. However, aspects of the present disclosures need not be limited to such a configuration. That is, the trailing end, in the conveying direction, of the n-th printing sheet 9 may pass through the discharging roller pair 72 at a timing when the conveying speed of the printing sheet 9 in the conveying process when the image recordation is performed on the (n+1)-th printing sheet 9 is less than the maximum value thereof.

Further, according to the above-described embodiment, description is made in a case where, when the conveying amount is lessened with respect to the conveying amount in the normal conveying process according to the first method or the second method of the adjusting process, the conveying speed is decreased with respect to the normal conveying speed, thereby the processing time of the conveying processes being the same as the processing time of the normal conveying process. However, aspects of the present disclosures need not be limited to such a configuration. For example, when the conveying amount is lessened with respect to the conveying amount in the normal conveying process by performing the adjusting process, the printing sheet may be conveyed at a conveying speed same as the normal conveying speed, and a standby period may be provided corresponding to a time period by which the conveying process is completed earlier than the normal conveying process.

Further, in the above-described embodiment, description is made in a case where, with respect to the conveying process performed within the period when the leading end, in the conveying direction, of the image area 91*a* is located within the image recording area F (see FIG. 6A) or the period when the trailing end, in the conveying direction, of the image area 91*a* is located within the image recording area F (see FIG. 6B), the conveying amount is adjusted according to the second method of the adjusting process. It is noted that aspects of the present disclosures need not be limited to such configurations. That is, the second method of the adjusting process may be a method of adjusting the conveying amount in the conveying process which is performed within a period during which at least a part of the image area 91*a* is located within the image recording area F.

In the above-described embodiment, description is made in a case where the (n+1)-th printing sheet 9 is fed after a particular time period has elapsed since the n-th printing sheet 9 is fed from the sheet feet tray 4 toward the image recording area F by the sheet feed roller 50. However, the timing at which the printing sheet 9 is fed need not be limited to the timing as described.

Further, according to the embodiment described above, description is made in a case where, when there is no image area on the upstream side, in the conveying direction, with respect to the image recording area F, the printing sheet 9 is conveyed until the trailing end, in the conveying direction, of the printing sheet 9 coincides with the front end, in the conveying direction, of the image recording area F. However, aspects of the present disclosures need not be limited to such a configuration. For example, when there is no image area on the upstream side of the printing sheet 9, in the conveying direction, with respect to the image recording area F, the printing sheets 9 (i.e., the preceding printing sheet 9 and the following printing sheet 9) may be conveyed until the trailing end of the image area which is arranged on most front side, in the conveying direction, of the printing sheet 9 conveyed next (i.e., the following printing sheets 9) coincides with the front end, in the conveying direction, of the image recording area F.

In the above-described embodiment, description is made in a case where the present disclosures are applied to the printer 10. However, aspects of the present disclosure need not be limited to such a configuration. For example, as far as an apparatus is configured to record an image according to a serial method for alternately repeating the conveying process and the scanning process, the present disclosures could be applied not only printers but to MFP's and copying machines.

What is claimed is:

1. An image recording apparatus comprising:

a carriage configured to move in a scanning direction;

a recording head mounted on the carriage and movable together with the carriage in the scanning direction, the recording head being configured to record an image on a recording medium;

a discharged sheet tray configured to accommodate the recording medium on which the image is recorded;

a conveyer configured to convey the recording medium in a conveying direction perpendicular to the scanning direction, the conveyer including a first roller and a second roller, the second roller being disposed on a downstream side with respect to the first roller in the conveying direction, the first roller being configured to convey the recording medium to an image recording area facing a movable range of the recording head, the second roller being configured to discharge the recording medium on the discharged sheet tray;

a driving mechanism including a single motor, the driving mechanism being configured to drive both the first roller and the second roller with use of the single motor as a driving source; and a controller configured to perform:

a conveying process of conveying the recording medium using at least one of the first roller and the second roller;

a recording process of recording an image on the recording medium using the recording head while moving the carriage in the scanning direction when the conveying direction is not performed; and an adjusting process of adjusting a conveying amount of the recording medium subject to at least one conveying process among a plurality of conveying processes performed within a particular conveying period such that a timing when a trailing end, in the conveying direction, of an n-th recording medium, which is one of a plurality of recording mediums subject to the recording process, passes through the second roller is within one of an acceleration period and a deceleration period in the plurality of conveying processes, n being an arbitrary natural number, the particular conveying period being a period from a start of a conveying process for an n-th recording medium until a timing after a start of a conveying process for an (n+1)-th recording medium and before an end of the conveying process for the n-th recording medium.

2. The image recording apparatus according to claim 1, wherein the controller perform the adjusting process such that a number of the recording process performed within the particular conveying period is a same as a number of the recording process when the adjusting process is not performed.

3. The image recording apparatus according to claim 1, wherein the controller adjusts, in the adjusting process, the conveying amount of the recording medium subject to at least one conveying process to be performed within a before-reaching period which is within the particular conveying period and before the (n+x)-th recording medium to be conveyed by the first roller reaches the first roller, wherein x is an arbitrary natural number.

4. The image recording apparatus according to claim 3, wherein the controller adjusts, in the adjusting process, the conveying amount of the recording medium subject to the conveying process to be performed within a period in which a non-image area of the n-th recording medium is located in the image recording area, the non-image area being an area on which no image is recorded over an entire width in the scanning direction.

5. The image recording apparatus according to claim 4, wherein the controller adjusts, in the adjusting process, the conveying amount and a conveying speed of the recording medium subject to the conveying process to be performed within a period in which the non-image area is located in the image recording area.

6. The image recording apparatus according to claim 3, wherein the controller adjusts, in the adjusting process, the conveying amount of the recording medium subject to the conveying process to be performed within a period in which an image area of the n-th recording medium is located in the image recording area, the image area being an area on which an image is to be recorded.

7. The image recording apparatus according to claim 6, wherein the controller adjusts, in the adjusting process, the conveying amount and a conveying speed of the recording medium subject to the conveying process to be performed within a period in which the image area is located in the image recording area.

8. The image recording apparatus according to claim 3 comprising an encoder configured to detect a rotation angle of the single motor, wherein the controller performs the adjusting process based on a detection signal of the encoder such that a trailing end, in the conveying direction, of the n-th recording medium passes through the second roller at a timing when a conveying speed of the recording medium in the conveying process when an image is recorded on the (n+1)-th recording medium is equal to or less than a half of a maximum value of the conveying speed.

9. The image recording apparatus according to claim 1, wherein the controller adjusts, in the adjusting process, the conveying amount of the recording medium subject to at least one conveying process to be performed within an after-reaching period which is within the particular conveying period and after the (n+x)-th recording medium to be conveyed by the first roller reaches the first roller, wherein x is an arbitrary natural number.

10. The image recording apparatus according to claim 9, wherein the controller adjusts, in the adjusting process, the conveying amount of the recording medium subject to the conveying process to be performed within a period in which a non-image area of the (n+x)-th recording medium is located in the image recording area, the non-image area being an area on which no image is recorded over an entire width in the scanning direction.

11. The image recording apparatus according to claim 9, wherein, when the (n+x)-th recording medium includes a non-image area on which no image is recorded over an entire width in the scanning direction, the controller adjusts, in the adjusting process, at least one of:

the conveying amount of the recording medium subject to the conveying process to be performed within a period in which a first image area, which is located in a downstream side with respect to the non-image area in the conveying direction, is located in the image recording area, the first image area being an area on which an image is to be recorded; and the conveying amount of the recording medium subject to the conveying process to be performed within a period in which a second image area, which is located in an upstream side with respect to the non-image area in the conveying direction, is located in the image recording area, the second image area being an area on which an image is to be recorded.

12. The image recording apparatus according to claim 1, wherein the second roller is a discharging roller configure to receive the recording medium conveyed by the first roller and discharge the recording medium on the discharged sheet tray.

13. The image recording apparatus according to claim 1, wherein the second roller is a switch-back roller configure to receive the conveying direction of the recording medium on which an image has been recorded and convey to the recording medium to the image recording area.

* * * * *